US010770790B1

(12) United States Patent
Mahanfar

(10) Patent No.: US 10,770,790 B1
(45) Date of Patent: Sep. 8, 2020

(54) UNI-DIMENSIONAL STEERING OF PHASED ARRAY ANTENNAS

(71) Applicant: Space Exploration Technologies Corp., Hawthorne, CA (US)

(72) Inventor: Alireza Mahanfar, Redmond, WA (US)

(73) Assignee: Space Exploration Technologies Corp., Hawthorne, CA (US)

( * ) Notice: Subject to any disclaimer, the term of this patent is extended or adjusted under 35 U.S.C. 154(b) by 0 days.

(21) Appl. No.: 15/908,602

(22) Filed: Feb. 28, 2018

Related U.S. Application Data

(60) Provisional application No. 62/596,647, filed on Dec. 8, 2017, provisional application No. 62/465,015, filed on Feb. 28, 2017.

(51) Int. Cl.

| | |
|---|---|
| ***H01Q 21/00*** | (2006.01) |
| ***H01Q 3/34*** | (2006.01) |
| ***H01Q 21/06*** | (2006.01) |
| *H01Q 15/14* | (2006.01) |
| *H01Q 15/02* | (2006.01) |

(52) U.S. Cl.
CPC ..... *H01Q 3/34* (2013.01); *H01Q 21/061* (2013.01); *H01Q 15/02* (2013.01); *H01Q 15/14* (2013.01)

(58) Field of Classification Search
CPC ..... H01Q 15/02
USPC ..... 343/893
See application file for complete search history.

(56) References Cited

U.S. PATENT DOCUMENTS

| | | | | |
|---|---|---|---|---|
| 9,882,279 | B2 * | 1/2018 | Bull | H01Q 3/34 |
| 2006/0276128 | A1 * | 12/2006 | Castiel | H04B 7/195 455/12.1 |
| 2016/0141754 | A1 * | 5/2016 | Leyh | H01Q 3/247 342/372 |
| 2017/0117628 | A1 * | 4/2017 | Banasky | H01Q 1/3233 |
| 2018/0115087 | A1 * | 4/2018 | Besoli | H01Q 21/22 |

* cited by examiner

*Primary Examiner* — Peguy Jean Pierre
(74) *Attorney, Agent, or Firm* — Polsinelli PC

(57) ABSTRACT

A phased array antenna system configured for communication with a satellite that emits or receives radio frequency (RF) signals and has a repeating ground track in a first direction, the antenna system includes a phased array antenna including a plurality of antenna elements distributed in a plurality of M columns oriented in the first direction and a plurality of N rows extending in a second direction normal to the first direction, and a plurality of fixed phase shifters aligned for phase offsets between antenna elements in the first direction and a gain-enhancement system configured for gain enhancement in the second direction of radio frequency signals received by and emitted from the phased array antenna.

13 Claims, 11 Drawing Sheets

UNI-DIMENSIONAL STEERING OF PHASED ARRAY ANTENNAS

CROSS-REFERENCES TO RELATED APPLICATIONS

The present application claims the benefit of U.S. Provisional Application Nos. 62/465,015 and 62/596,647, filed respectively, Feb. 28, 2017, and Dec. 8, 2017, the disclosures of which are hereby expressly incorporated by reference herein in their entirety.

BACKGROUND

An antenna (e.g., a dipole antenna) typically generates radiation in a pattern that has a preferred direction. For example, the generated radiation pattern is stronger in some directions and weaker in other directions. Likewise, when receiving electromagnetic signals, the antenna has the same preferred direction. Signal quality (e.g., signal to noise ratio or SNR), whether in transmitting or receiving scenarios, can be improved by aligning the preferred direction of the antenna with a direction of the target or source of signal. However, it is often impractical to physically reorient the antenna with respect to the target or source of signal. Additionally, the exact location of the source/target may not be known. To overcome some of the above shortcomings of the antenna, a phased array antenna can be formed from a set of antenna elements to simulate a large directional antenna. An advantage of the phased array antenna is its ability to transmit and/or receive signals in a preferred direction (i.e., the antenna's beamforming ability) without physically repositioning or reorienting the system.

It would be advantageous to provide improved phased array antennas having increased bandwidth while having a high ratio of the main lobe power to the side lobe power. Likewise, it would be advantageous to provide improved phased array antennas having reduced cost and power budgets. Accordingly, embodiments of the present disclosure are directed to these and other improvements in phase array antennas.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a phased array antenna system configured for communication with a satellite that emits or receives radio frequency (RF) signals and has a repeating ground track in a first direction is provided. The antenna system includes: a phased array antenna including a plurality of antenna elements distributed in a plurality of M columns oriented in the first direction and a plurality of N rows extending in a second direction normal to the first direction, and a plurality of fixed phase shifters aligned for phase offsets between antenna elements in the first direction; and a gain-enhancement system configured for gain enhancement in the second direction of radio frequency signals received by and emitted from the phased array antenna.

In another embodiment of the present disclosure, a method of uni-dimensionally steering in a coordinate system a phased array antenna system configured for communication with a satellite constellation that emits or receives radio frequency (RF) signals and has a repeating ground track in a first direction is provided. The method includes: identifying a repeating ground track of the satellite constellation in a first direction; orienting a phased array antenna in the first direction, the antenna including a plurality of antenna elements distributed in a plurality of M columns oriented in the first direction and a plurality of N rows extending in a second direction normal to the first direction, and a plurality of phase shifters aligned for phase offsets between antenna elements in the first direction; enhancing gain in the second direction of radio frequency signals received by and emitted from the phased array antenna; and receiving and/or emitting RF signals between the satellite constellation and the antenna.

In any of the embodiments described herein, the gain enhancement system may be selected from the group consisting of a lens system, a reflector system, a superstrate system, and combinations thereof.

In any of the embodiments described herein, the lens system may include a semi-cylindrical or a cylindrical lens having a longitudinal axis oriented parallel to the first direction.

In any of the embodiments described herein, the gain enhancement system may include a predetermined number of M columns.

In any of the embodiments described herein, the number of N rows is greater than or equal to the number of M columns.

In any of the embodiments described herein, the phased array antenna system further may include a controller configured to turn individual antenna elements on and off.

In any of the embodiments described herein, the coordinate system may be spherical or Cartesian.

In any of the embodiments described herein, the method of steering may further include switching individual antenna elements on and off by a controller.

In any of the embodiments described herein, the controller may receive an input from a global positioning system (GPS), and wherein the input includes a position of the satellite.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
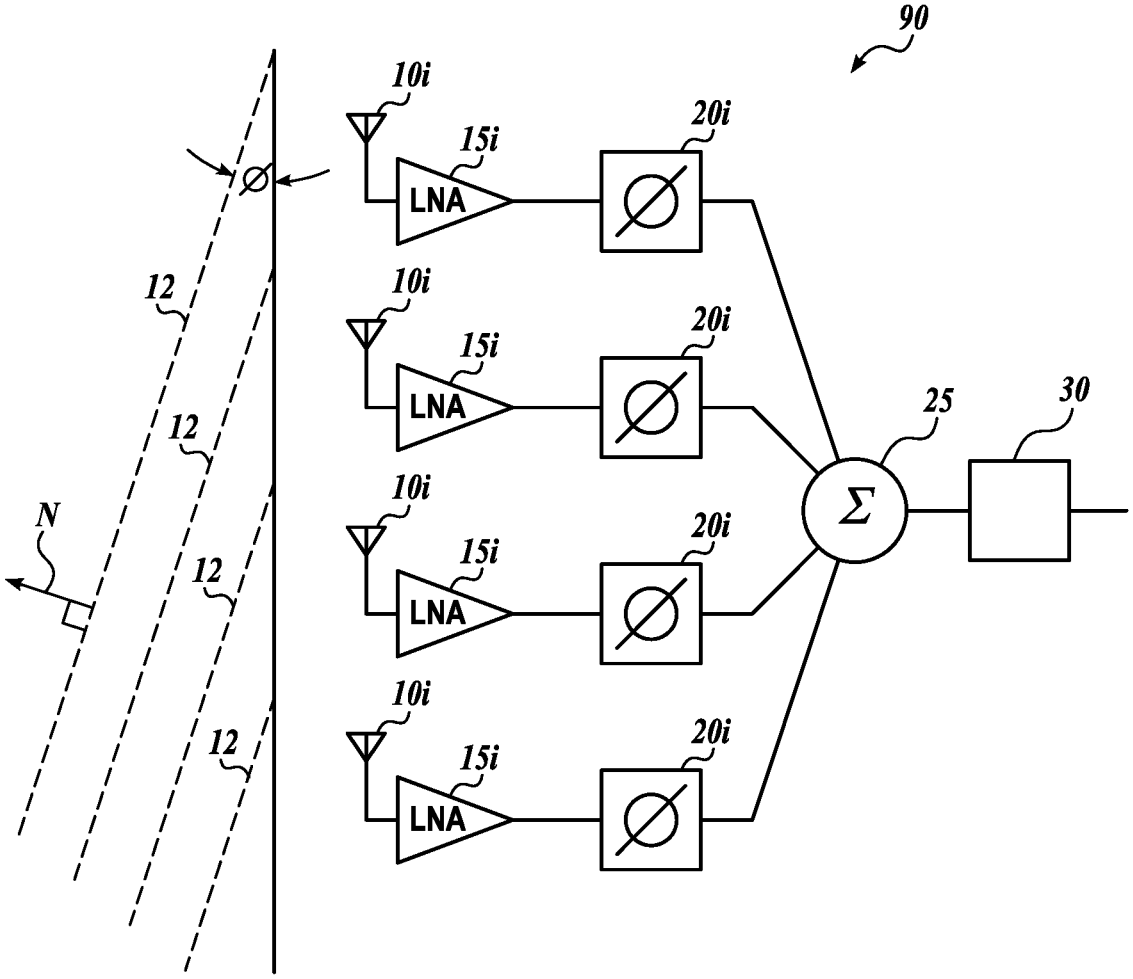
FIG. 1 illustrates a phased array antenna in accordance with embodiments of the present disclosure.

Embodiments of systems and methods relate to phased array antennas including gain enhancement systems for one dimensional steering of phased array antennas. In accordance with one embodiment of the present disclosure a phased array antenna system is configured for communication with a satellite that emits or receives radio frequency (RF) signals and has a repeating ground track in a first direction. The antenna system includes a phased array antenna including a plurality of antenna elements distributed in a plurality of M columns oriented in the first direction and a plurality of N rows extending in a second direction normal to the first direction, and a plurality of fixed phase shifters aligned for phase offsets between antenna elements in the first direction. The antenna system further includes a gain-enhancement system configured for gain enhancement in the second direction of radio frequency signals received by and emitted from the phased array antenna.

In other embodiments, methods are provided for unidimensionally steering in a coordinate system a phased array antenna system configured for communication with a satellite constellation that emits or receives radio frequency (RF) signals and has a repeating ground track in a first direction. These and other aspects of the present disclosure will be more fully described below.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, it may not be included or may be combined with other features.

Figure 2A:
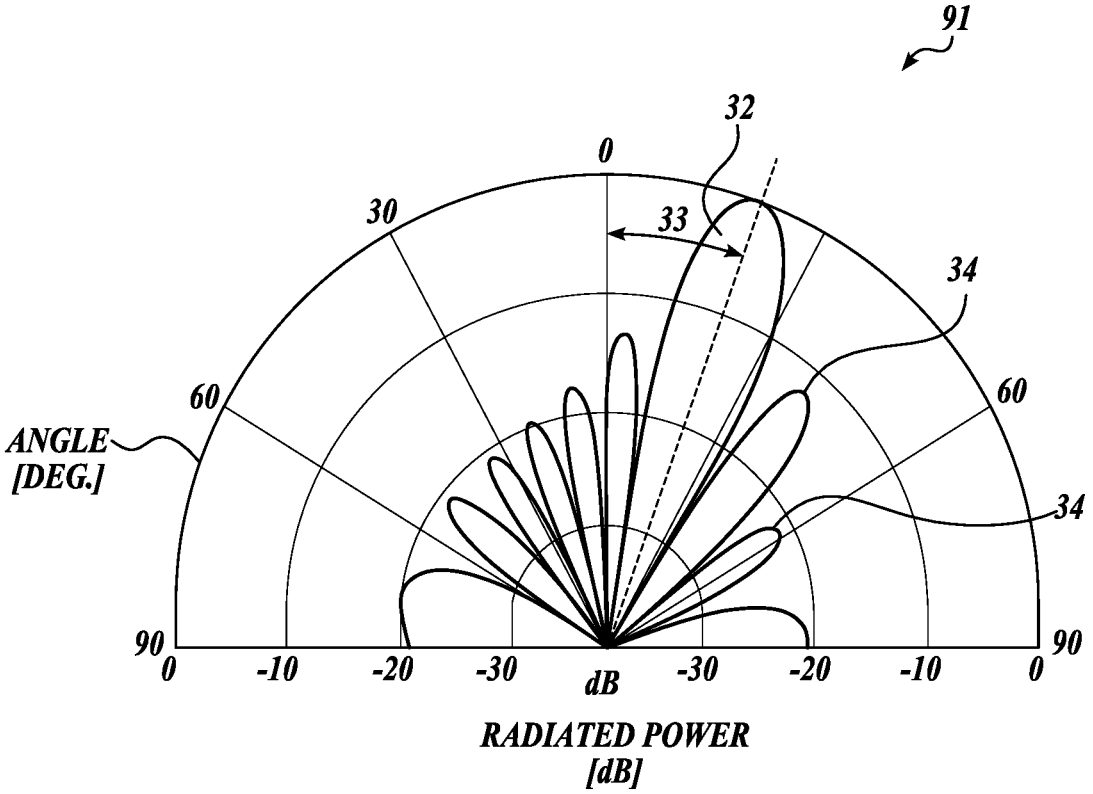
FIG. 2A is a graph of a main lobe and undesirable side lobes of an antenna signal.

FIG. 1 is a schematic illustration of a phased array antenna transmitter system 90 in accordance with embodiments of the present disclosure. The illustrated system includes multiple antenna elements 10 configured for transmitting a signal. The outgoing radio frequency (RF) signals are routed from a modulator 30 via a distributer 25 to individual phase shifters 20. The RF signal is phase-offset by the phase shifters 20 by different phases, which vary by a predetermined amount from one phase shifter to another. For example, the phases of the common RF signal can be shifted by 0° at the bottom phase shifter 20 in FIG. 1, by $\Delta\alpha$ at the next phase shifter 20 in the column, by $2\Delta\alpha$ at the next phase shifter, and so on. As a result, the RF signals that arrive to amplifiers 15 (when transmitting, the amplifiers are power amplifiers "PAs") are phase-offset. The PAs 15 amplify these phase-offset RF signals, and antenna elements 10 emit the RF signals as electromagnetic waves. Because of the phase offsets, the RF signals from individual antenna elements 10 are combined into outgoing wave fronts 12 that are inclined at angle $\phi$ from the line of the antenna elements 10. The angle $\phi$ is called angle of antenna (AoA) or a beamforming angle. Therefore, the choice of the phase offset $\Delta\alpha$ determines the directivity of the wave fronts 12. As seen in FIG. 2A, an exemplary phased array antenna radiation pattern is shown.

At the receiving phased array antenna, the wave fronts 12 can be detected by another set of individual antenna elements, and amplified by amplifiers 15 (when receiving signals the amplifiers are low noise amplifiers "LNAs"). For any non-zero AoA, the antenna elements 10 are reached by the same wave front at different times. Therefore, the received signal will generally include phase offsets from one antenna element of the receiving (RX) antenna to another. Analogous to the emitting phased array antenna case, these phase offsets can be adjusted-for by another set of phase shifters 20 connected to the respective antenna elements. For example, each phase shifter 20 (e.g., a phase shifter chip) can be programmed to adjust the phase of the signal to the same reference, such that the phase offset among the individual antenna elements is canceled in order to combine the RF signals corresponding to the same wave front 12. As a result of this constructive combining of signals, a higher signal to noise ratio (SNR) can be attained on the received signal, which results in increased channel capacity.

FIG. 2A is a graph of main and side lobes of an antenna signal in accordance with embodiments of the present disclosure. The horizontal axis shows radiated power in dB. The radial axis shows angle of the RF field in degrees. The main lobe 32 represents the strongest RF field that is generated in a preferred direction by a phased array antenna. In the illustrated case, a desired directivity 33 of the main lobe 32 corresponds to about 20°. Typically, the main lobe 32 is accompanied by a number of side lobes 34 that are generally undesirable because the side lobes 34 derive their power from the same power budget thereby reducing the available power for the main lobe 32. Furthermore, in some instances the side lobes 34 may reduce SNR at the receiving antenna. An approach for reducing the side lobes 34 includes antenna elements 10 arranged in a lattice with the antenna elements 10 being phase offset such that the phased array antenna emits a waveform in a preferred direction.

Figure 2B:
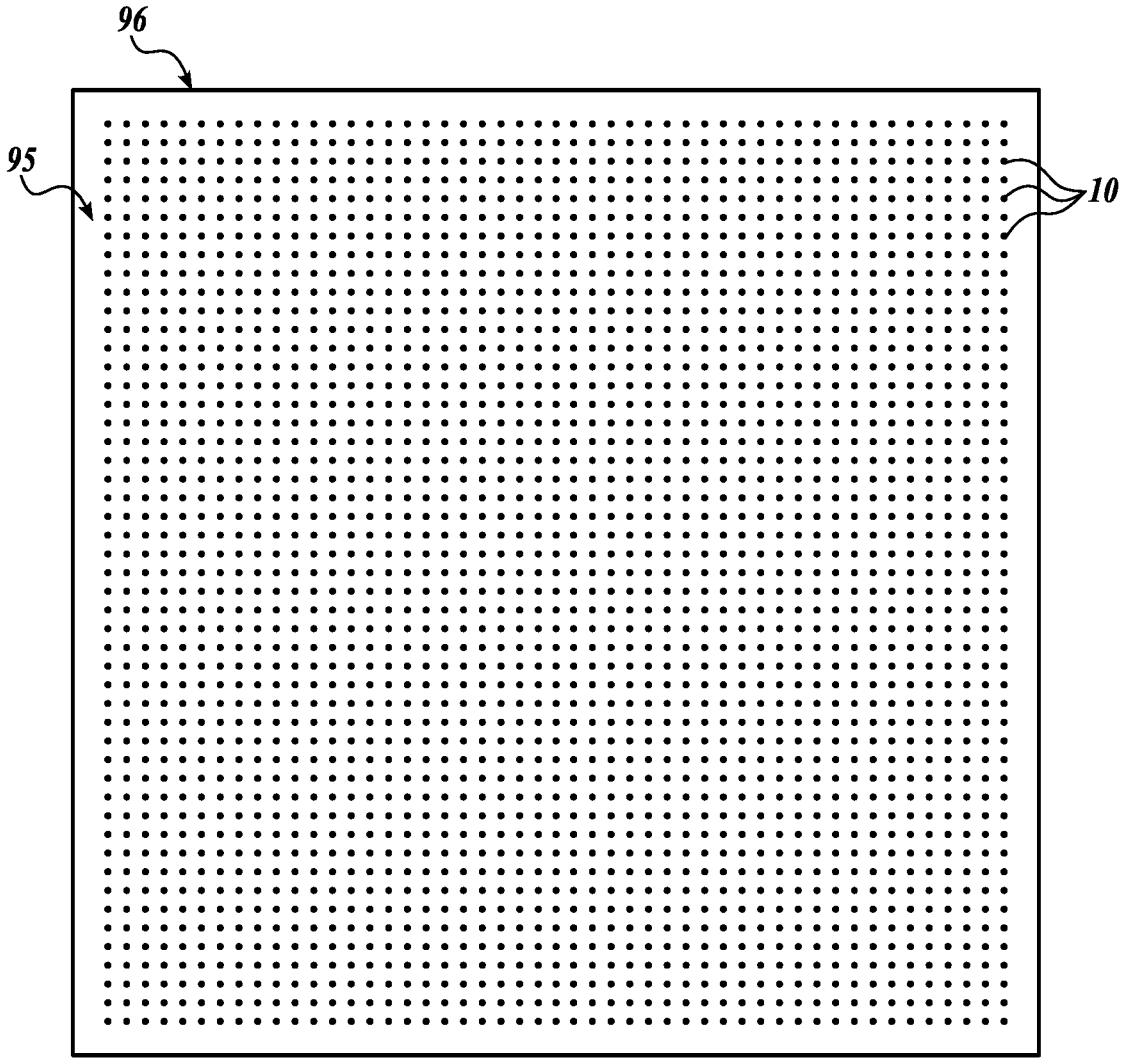
FIG. 2B is a schematic layout of individual antenna elements of a phased array antenna in accordance with embodiments of the present disclosure.

FIG. 2B shows schematic layouts of individual antenna elements of a phased array antenna. The illustrated phased array antenna 96 included antenna elements 10 that are arranged in 2D arrays. For example, the phased array antenna 96 has a rectangular arrangement of the antenna elements 10. In other embodiments, the phased array antenna may have another arrangement of antenna elements, for example, a circular arrangement on the antenna elements. The antenna elements 10 that are arranged in multiple rows and columns can be phase offset such that the phased array antenna emits a waveform in a preferred direction. When the phase offsets to individual antenna elements are properly applied, the combined wave front has a desired directivity of the main lobe.

Figure 3:
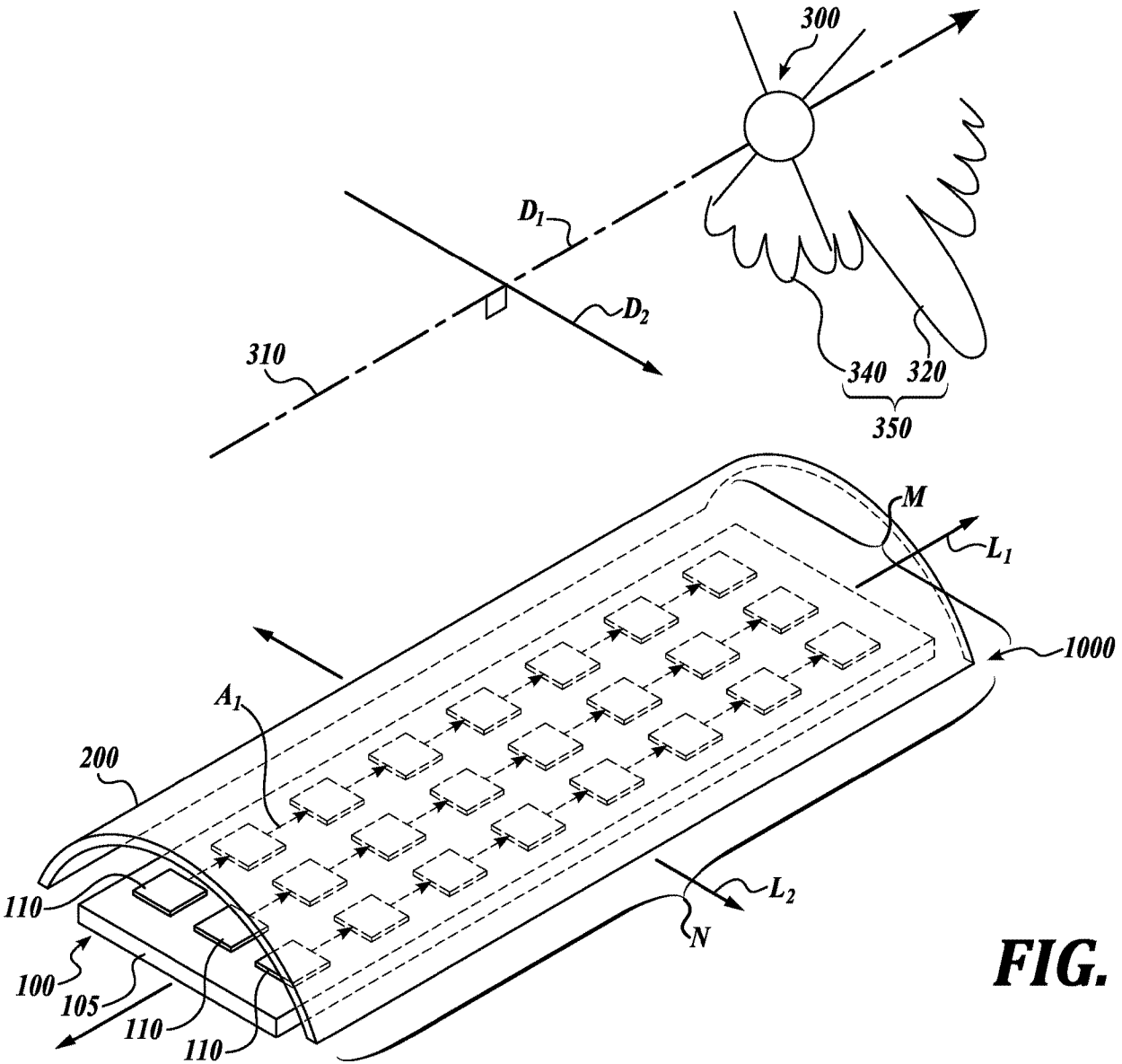
FIG. 3 is a schematic layout of individual antenna elements of a phased array antenna including a gain enhancement system in accordance with an embodiment of the present disclosure.

FIG. 3 is a schematic layout of individual antenna elements 110 of a phased array antenna 100 in accordance with one embodiment of the present technology. The antenna includes a plurality of rows N and a plurality of columns M of antenna elements 110 on a substrate 105 defining an antenna array. The antenna 100 includes a gain enhancement system 200 for directing beams to and from to the array of antenna elements 110 in a certain direction. Suitable gain enhancement systems in accordance with embodiments of the present disclosure may include lenses, reflectors, superstrate grating, and any suitable combinations thereof.

In the illustrated embodiment, the phased array antenna 100 includes a lesser number columns M of individual antenna elements 110 as compared to rows N of individual antenna elements 110. Accordingly, the columns M aligned along the longitudinal axis L of the cylindrical lens 200, resulting in a rectangular phased array antenna. In other embodiments of the present disclosure, the number of columns M and rows N may be equal. In other embodiments, the number of rows N may exceed the number of columns M.

In the illustrated embodiment, the antenna 100 includes three columns and eight rows of antenna elements 110. However, other numbers of antenna elements are within the scope of the present disclosure. In the illustrated embodiment, the array of antenna elements is shown as a planar array. However, non-planar, conformal arrays are also within the scope of the present disclosure.

The columns M and rows N of the illustrated embodiment are configured to be arranged in parallel lines or along parallel lines that are normal to one another. Therefore, the columns M extend in a first direction along a longitudinal axis L1 of the phased array antenna 100 and the rows extend in a second direction along a lateral axis L2 of the phased array antenna 100. The antenna elements need not be arranged exactly in straight lines and may be offset from the line to be arranged along the line.

The antenna elements may be equally spaced along columns and/or rows, or the antenna elements may include irregular spacing along columns and/or rows. In accordance with embodiments of the present disclosure the antenna elements may be arranged in a space tapered configuration.

Referring to FIG. 3, in accordance with one embodiment of the present disclosure, a satellite 300 travels along a known trajectory 310 in direction D1 while emitting and receiving RF signals 350 to and from a phased array antenna system 1000. Only one satellite 300 is illustrated in FIG. 3. However, multiple satellites may communicate with a phased array antenna 100, the satellites traveling along a repeating ground track. Generally, when the satellite trajectory 310 is synchronized and repeating with the surface of the Earth, the orientation of the communicating RF signal 350 with respect to the receiving and transmitting phased array antenna 100 on the Earth is determinable.

In the illustrated embodiment, the antenna elements 110 in each of the columns M are configured as a phased array. A phased array is an electronically scanned array of antenna elements which creates a signal beam that can be electronically steered to point in different directions without moving the antenna elements. The relative amplitudes of and constructive and destructive interference effects among the signals radiated by the individual antennas determine the effective radiation pattern of the array. Therefore, phased array antennas emit RF signals as a main lobe accompanied by side lobes. In a phased array, power from the transmitter is fed to the antennas through phase shifters, which are controlled by a computer system to alter the phase electronically, thus steering the beams to different directions, for example, to add together to increase the radiation in a desired direction, while cancelling to suppress radiation in undesired directions.

Accordingly, phase shifters are used to phase shift between antenna elements 110 along each column M in the direction D1 of the satellite 300, as indicated by the small arrows. Comparatively, in a conventional two-dimensional antenna array, numerous phase shifters are needed for multi-dimensional steering in two dimensions.

When the path D1 of the incoming beam is known in advance, as is the case with the satellite constellation that travels along repeating or synchronized ground tracks, the gain enhancement system can be configured to focus (direct or "steer") the incoming RF radiation onto a set of antenna elements. As a result, the intensity of the RF signal increases at these antenna elements in one direction. Therefore, phase offsets to individual antenna elements in this direction can be reduced by using the gain enhancement system.

In embodiments of the present disclosure, a gain enhancement system is disposed between the source of the RF signal 350 and the phased array antenna system 100 to direct the main lobe 320 of the RF radiation onto a set of the individual antenna elements 110. Therefore, in some embodiments of the present disclosure, the number of phase shifters per antenna element can be reduced if phase shifting is only required in one direction of the array of antenna elements instead of in two directions. For example, in the direction of gain enhancement D2, phase shifting may not be required.

As a result of the gain enhancement system, the number of the antenna elements in the antenna may also be reduced in some embodiments of the present disclosure. For example, antenna elements outside of the focus area of the gain enhancement system can be eliminated, while still maintaining the overall strength of the RF signal at acceptable levels. A reduced count of antenna elements reduces the count of the accompanying integrated circuit (IC) chips (e.g., phase shifters and power amplifiers (PAs)) therefore also reducing the cost and power consumption of the phased array antenna. The reduced number of the antenna elements can also reduce the size and increase reliability of the phased array antenna.

In some embodiments of the present disclosure, the gain enhancement system can be used for communication with one or more satellites in a satellite constellation traveling along a repeating ground track. In a two-dimensional, planar or non-planar array of antennas, for which the repeating ground tracking pattern of the satellite constellation is known, gain enhancement is added to the system in a direction D2 substantially normal to the direction D1 of the repeating ground tracking pattern. In one non-limiting example, the direction D1 of the trajectory 310 of the satellite 300 is generally parallel to the longitudinal axis L1 of the illustrated phased array antenna 100, while being generally perpendicular to the lateral axis L2 phased array antenna 100.

A method of uni-dimensionally steering in a coordinate system a phased array antenna system configured for communication with a satellite constellation that emits or receives radio frequency (RF) signals and has a repeating ground track in a first direction includes identifying a repeating ground track of the satellite constellation in a first direction, orienting a phased array antenna in the first direction, enhancing gain in the second direction of radio frequency signals received by and emitted from the phased array antenna, and receiving and/or emitting RF signals between the satellite constellation and the antenna. The antenna includes a plurality of antenna elements distributed in a plurality of M columns oriented in the first direction and a plurality of N rows extending in a second direction normal to the first direction, and a plurality of phase shifters aligned for phase offsets between antenna elements in the first direction. The coordinate system may be spherical or Cartesian.

In the illustrated embodiment of FIG. 3, the gain enhancement system is an antenna lens 200 disposed between the phased array antenna 100 and the satellite 300. In one embodiment of the present disclosure, the lens 200 is configured for concentrating, dispersing, or otherwise modifying the direction of movement of light, sound, electrons, etc. To achieve such effect, the antenna lens 200 may be curved. The antenna lens 200 can be made of, for example, glass, polymers, epoxies, or other materials that transmit RF radiation.

Referring to FIG. 3, the antenna lens 200 focuses the incoming RF signal 350 onto individual antenna elements 110 of the phased array antenna 100 in the direction D2 of the lateral axis L2 of the antenna 100. The antenna lens 200 has a focusing direction D2 oriented generally perpendicular to the direction D1 of the trajectory 310 of the satellite 300.

In the illustrated embodiment, the antenna lens 200 is a semi- or partial cylindrically-shaped lens that focuses the RF signal (e.g., the main lobe 320 of the RF signal 350) onto several arrays of the individual antenna elements 110 that are carried by a substrate 105 (e.g., a printed circuit board (PCB) or a ceramic carrier). In other embodiments, the antenna lens 200 may be oriented in a flat configuration or another curved configuration besides a semi-cylindrically shaped configuration.

As a result of the antenna lens 200, the RF signal intensity or the signal-to-noise ratio (SNR) increases for the antenna elements 110. As the signal intensity or SNR is increased, the number of columns M of antenna elements 110 may be reduced (as compared to the number of rows N) while still maintaining acceptable signal strength. In comparison, phased array antennas of previously developed technologies have generally square or circular configurations, because the direction of the incoming RF signal is not known or continually changes. In contrast, the illustrated phased array antenna 100 includes a lesser number of columns M of the individual antenna elements 110 aligned along the lateral axis L2 of the cylindrical lens 200 as compared to rows N along the longitudinal axis L1, resulting in a rectangular-shaped phased array antenna.

Figure 4:
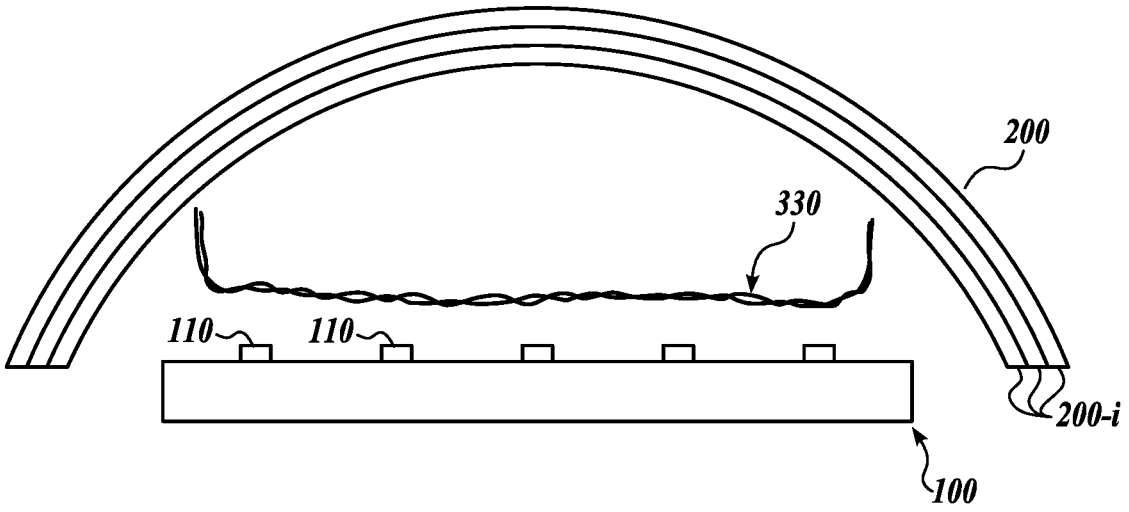
FIG. 4 is a schematic view of a phased array antenna including a gain enhancement system in accordance with another embodiment of the present disclosure.

FIG. 4 is a schematic view of a phased array antenna 100 an antenna lens 200 in accordance with another embodiment of the present disclosure. In the illustrated embodiment of FIG. 4, the antenna lens 200 includes multiple layers 200*i*. For example, individual layers 200*i* may be made of materials that have different refraction coefficient. In some embodiments, the individual layers 200*i* may be made from different polymers that may be adhered or fused together. The individual layers 200*i* may be selected and combined to improve focusing of the RF signal 350 at different frequencies, for example, in V-band or Ka-band.

Figure 5:
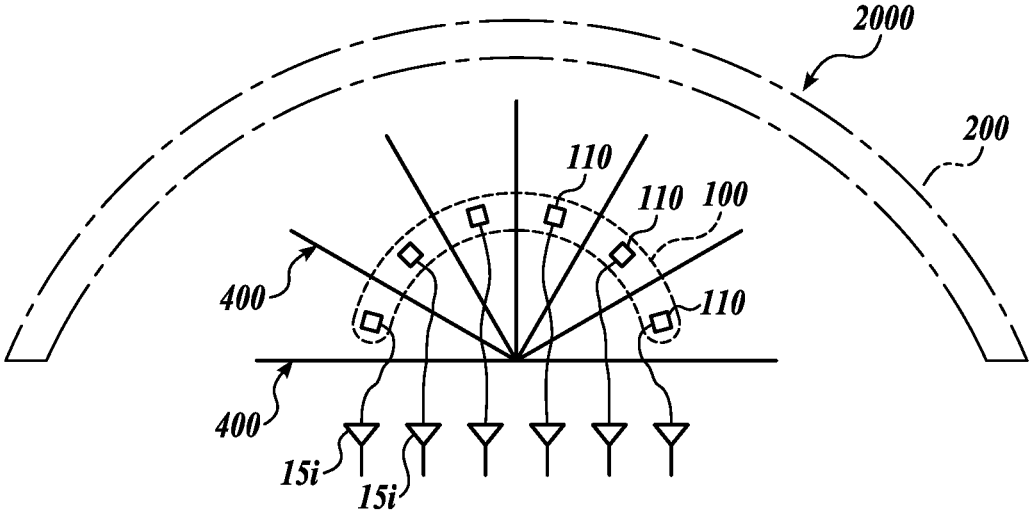
FIG. 5 is a schematic view of a phased array antenna including a gain enhancement system in accordance with another embodiment of the present disclosure.

FIG. 5 is a schematic view of a phased array antenna system 2000 in accordance with another embodiment of the present technology. The illustrated embodiment includes a gain enhancement system shown as a plurality of reflectors 400 to focus the RF signals 350 onto the antenna elements 110 of the phased array antenna 100. For example, the reflectors 400 may receive the incoming RF signals 350 through the antenna lens 200, and then reflect the incoming RF signal to the antenna elements 110. The received RF signals may be routed to individual LNAs 15*i*, and further to other elements of the RF receiver.

Suitable reflectors may include mirrors or other reflective surfaces. The reflectors 400 may be made of metals (e.g., copper, aluminum, steel, etc.) that do not significantly transmit/absorb the RF signal 350 at the frequency of interest (e.g., V-band, Ka-band, etc.).

In the illustrated embodiment of FIG. 5, the gain enhancement system includes an optional lens 200 for enhancing gain together with the reflector 400. However, the gain enhancement system of the illustrated embodiment may operate for suitable gain enhancement with or without the optional lens 200.

Figure 6A:
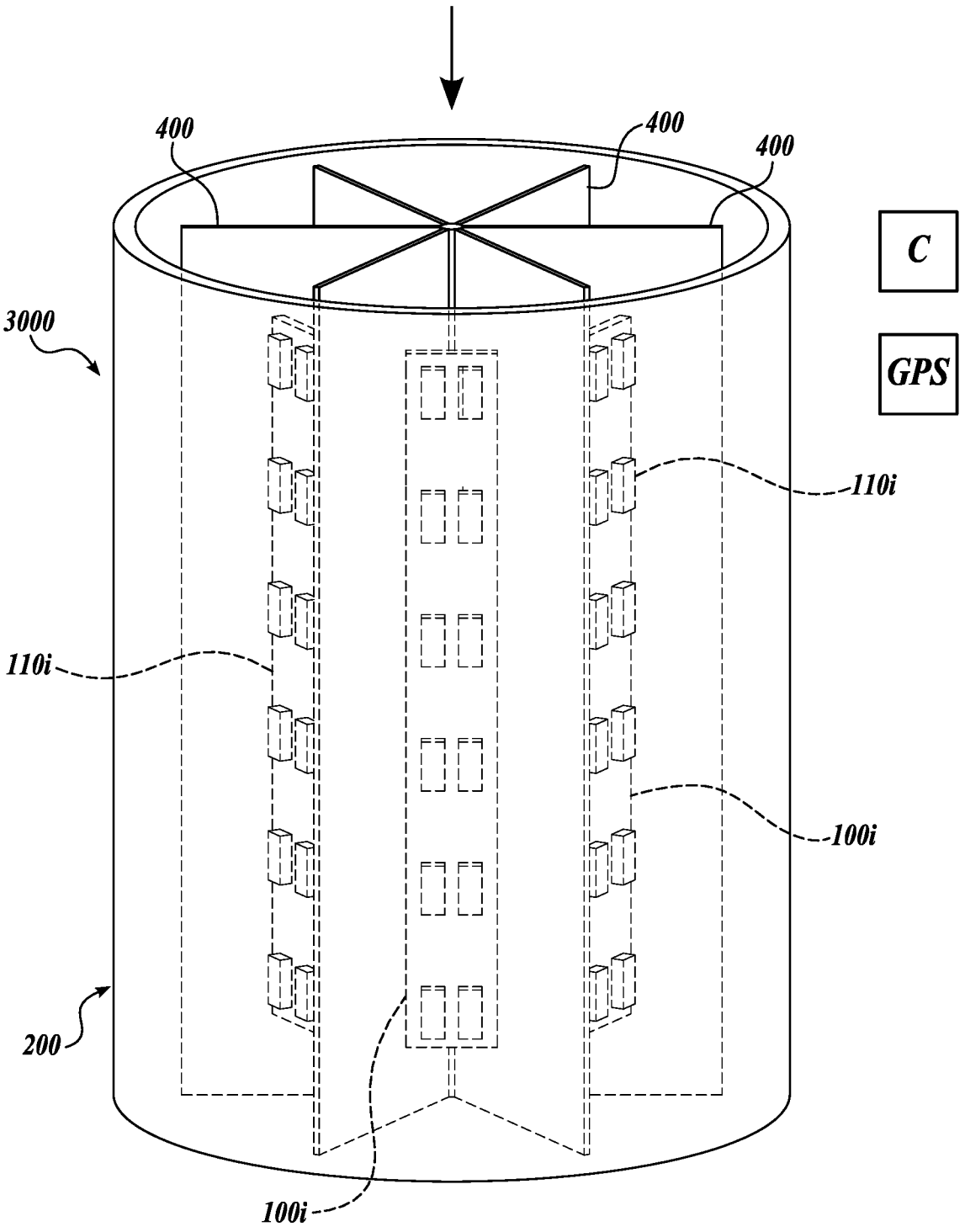
FIG. 6A is an isometric view of a phased array antenna system including a gain enhancement system in accordance with another embodiment of the present disclosure.

FIG. 6A is an isometric view of a phased array antenna system 3000 in accordance with another embodiment of the present technology. The phased array antenna system 3000 can include several separate phased array antennas 100 each including antenna elements 110. Multiple phased array antennas 100 can be arranged circumferentially, separated by separating elements, such as reflectors 400. In some embodiments, an optional cylindrical antenna lens 200 focuses the RF signal 350 onto the antenna elements 110*i* of the phased array antennas 100. Reflectors 400 can also focus the RF signal to the antenna elements 110*i* of phased array antennas 100 by reflecting the RF signal.

In some embodiments, depending on the location of the satellite 300 and the orientation of the antenna elements 110*i*, the phased array antennas 100 may be differently exposed to the incoming RF signal 350. For example, the antenna elements 110*i* that are oriented circumferentially to face the satellite 300 at given time may receive stronger RF signal 350, while those antenna elements 110*i* that face away or sideways from the satellite 300 may receive weaker RF signal. In some embodiments, a controller C may turn off those antenna elements 110*i* that receive a weak RF signal to, for example, reduce energy consumption, improve system reliability, or to reserve the turned-off antenna elements for the RF signal coming from a different satellite. The controller C may at least partially rely on a global positioning system GPS to interpret a spatial relationship between the satellite or satellites 300 and the phased array antenna system 3000.

Figure 6B:
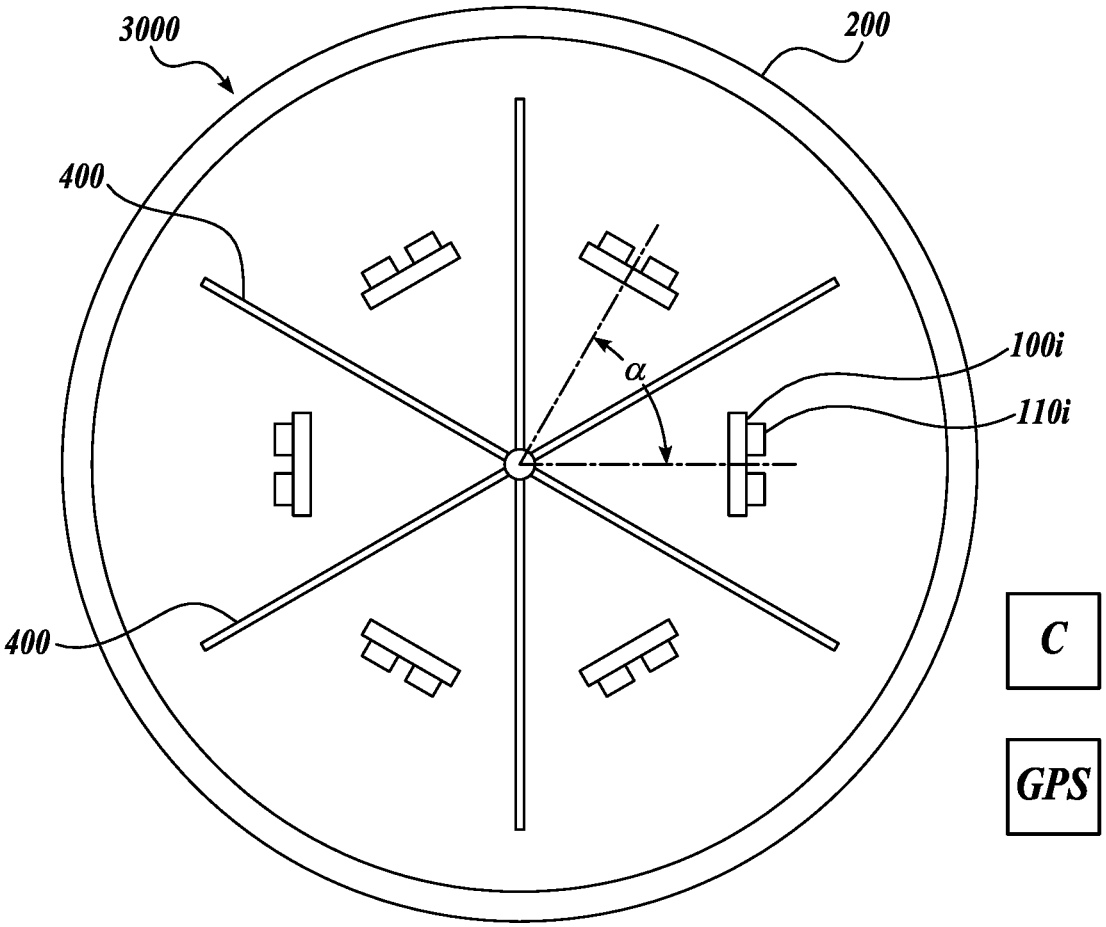
FIG. 6B is a top plan view of the phased array antenna system shown in FIG. 6.

FIG. 6B is a top plan view of the phased array antenna system 3000 shown in FIG. 6A. The system 3000 includes circumferentially arranged phased array antennas 100*i*. The illustrated phased array antennas are uniformly offset circumferentially by angle $\alpha$, but non-uniform arrangements of the phased array antennas 100*i* are also possible. As explained with reference to FIG. 6A, the controller C may turn the antenna elements on and off based on the location of the satellite and the system.

Referring to the illustrated embodiment of FIGS. 6A and 6B, the phased array antennas 100*i* may include one or more columns of the antenna elements 110*i*. Although the antennas 100*i* are shown as including two columns of antenna elements 110*i*, other numbers of columns are also within the scope of the present disclosure.

Figure 7A:
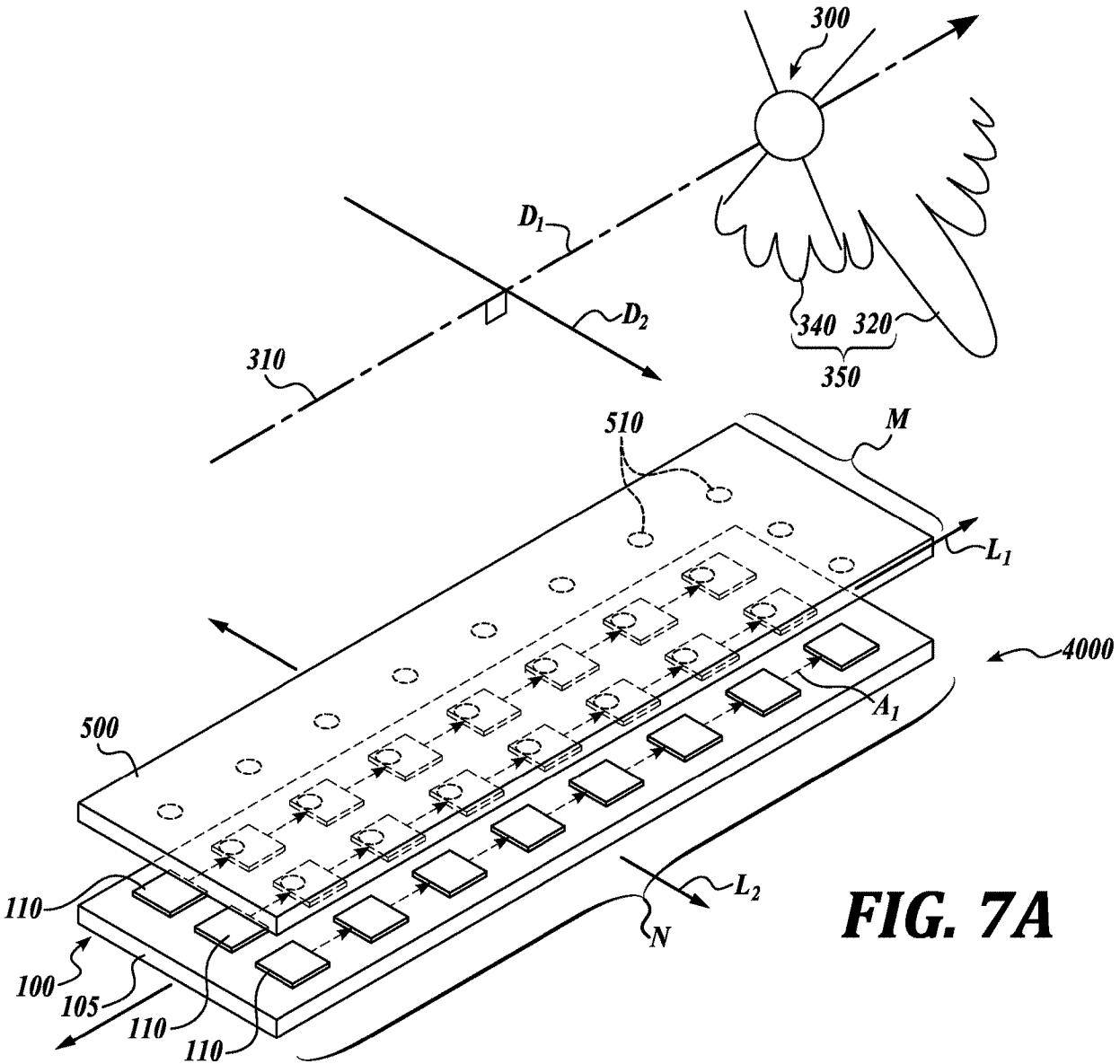
FIG. 7A is an isometric view of a phased array antenna system including a gain enhancement system in accordance with another embodiment of the present disclosure.
Figure 7B:
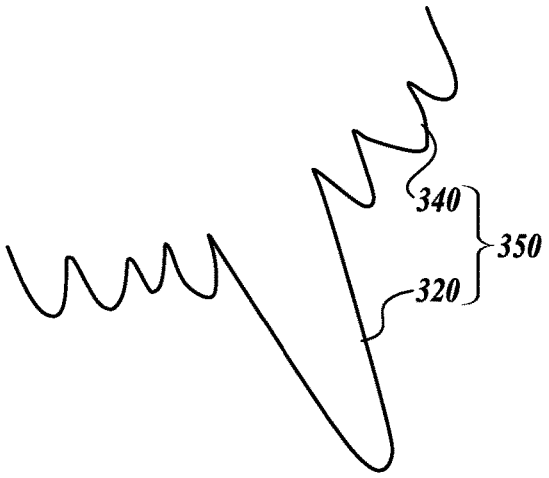
FIG. 7B is a side view of the phased array antenna system shown in FIG. 7.
Figure 7B:
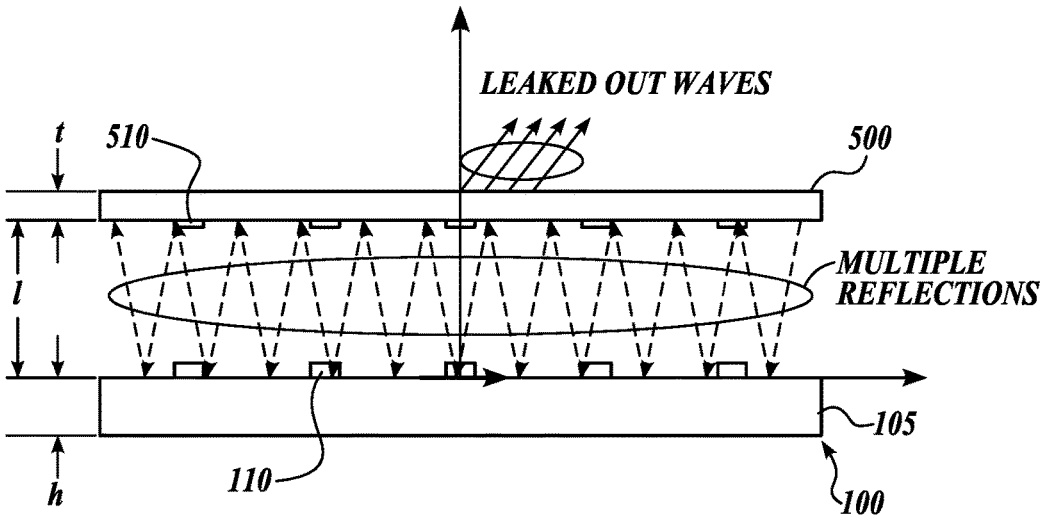

FIG. 7A is an isometric view of a phased array antenna system 4000 in accordance with another embodiment of the present technology. FIG. 7B is a side view of the phased array antenna system 4000 shown in FIG. 7A. In the illustrated embodiment of FIGS. 7A and 7B, the gain enhancement system 500 includes a superstrate grating 510 to create a resonance cavity for directivity enhancement. The superstrate grating 510 provides gain enhancement by creating a resonance cavity between a free-standing metal strip 510 and an electric Hertzian dipole on the grounded dielectric slab substrate 100. Therefore, the resonance cavity provides multiple reflections between the ground plane and the superstrate 510 as can be seen in FIG. 7B, with a reduce area for the wave to leak out.

Figure 8C:
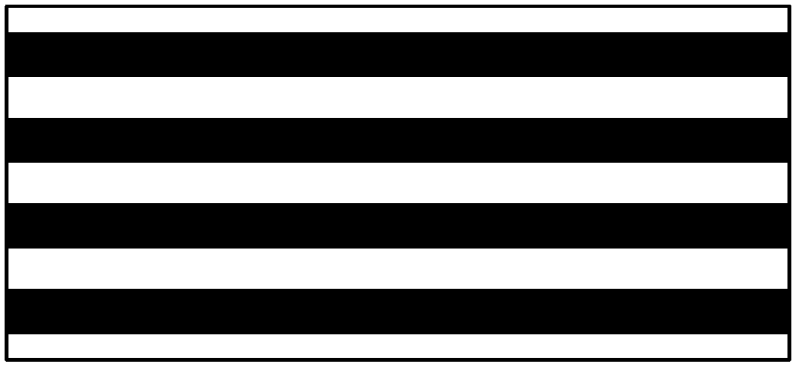
FIGS. 8A, 8B, and 8C are various top plan views of gain enhancement systems in accordance with embodiments of the present disclosure.
Figure 8B:
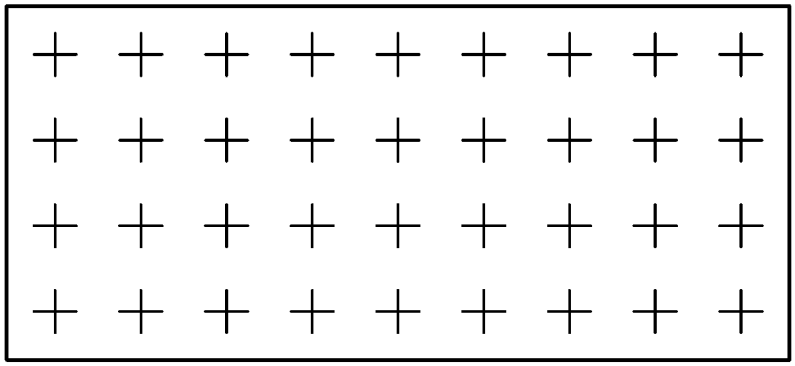
Figure 8A:
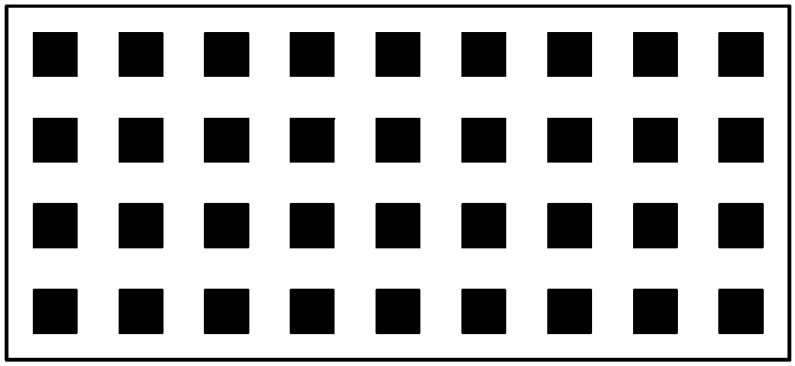

FIGS. 8A, 8B, and 8C are top plan views of various non-limiting examples of superstrate grating in accordance with embodiments of the present disclosure. Other embodiments are also within the scope of the present disclosure, including grating patterns having switches for opening and closing the grating depending on the direction of communication.

Many embodiments of the technology described above may take the form of computer- or controller-executable instructions, including routines executed by a programmable computer or controller. Those skilled in the relevant art will appreciate that the technology can be practiced on computer/controller systems other than those shown and described above. The technology can be embodied in a special-purpose computer, controller or data processor that is specifically programmed, configured or constructed to perform one or more of the computer-executable instructions described above. Accordingly, the terms "computer" and "controller" as generally used herein refer to any data processor and can include Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display or LCD.

From the foregoing, it will be appreciated that specific embodiments of the technology have been described herein for purposes of illustration, but that various modifications may be made without deviating from the disclosure. For example, in some embodiments, curved mirrors 400 can be used to focus RF signal onto the antenna elements 110. In some embodiments, the focal point (or area) of the curved mirrors 400 correspond to the location of the antenna elements 110. In some embodiments, the antenna lens/mirror can be optimized for particular frequency or angle of attack (AoA) of the RF signal from the satellite. Moreover, while various advantages and features associated with certain embodiments have been described above in the context of those embodiments, other embodiments may also exhibit such advantages and/or features, and not all embodiments need necessarily exhibit such advantages and/or features to fall within the scope of the technology. Accordingly, the disclosure can encompass other embodiments not expressly shown or described herein.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A phased array antenna system configured for communication with a satellite that emits or receives radio frequency (RF) signals and has a repeating ground track in a first direction, the antenna system comprising:

a phased array antenna including a plurality of antenna elements distributed in a plurality of M columns oriented in the first direction and a plurality of N rows extending in a second direction normal to the first direction, and a plurality of fixed phase shifters aligned for phase offsets between antenna elements in the first direction;

a gain-enhancement system configured for gain enhancement in the second direction of radio frequency signals received by and emitted from the phased array antenna; and a controller configured to turn individual antenna elements on and off based at least in part on orientations of the individual antenna elements relative to the satellite, wherein an orientation of an individual antenna element relative to the satellite is correlated with a strength of RF signals received by the individual antenna element from the satellite.

2. The phased array antenna system of claim 1, wherein the gain enhancement system is selected from the group consisting of a lens system, a reflector system, a superstrate system, and combinations thereof.

3. The phased array antenna system of claim 2, wherein the lens system includes a semi-cylindrical or a cylindrical lens having a longitudinal axis oriented parallel to the first direction.

4. The phased array antenna system of claim 1, wherein the phased array antenna includes a predetermined number of M columns.

5. The phased array antenna system of claim 1, wherein the number of N rows is greater than or equal to the number of M columns.

6. A method of uni-dimensionally steering in a coordinate system a phased array antenna system configured for communication with a satellite constellation that emits or receives radio frequency (RF) signals and has a repeating ground track in a first direction, the method comprising:

identifying a repeating ground track of the satellite constellation in a first direction;

orienting a phased array antenna in the first direction, the antenna including a plurality of antenna elements distributed in a plurality of M columns oriented in the first direction and a plurality of N rows extending in a second direction normal to the first direction, and a plurality of phase shifters aligned for phase offsets between antenna elements in the first direction;

enhancing gain in the second direction of radio frequency signals received by and emitted from the phased array antenna;

receiving and/or emitting RF signals between the satellite constellation and the antenna; and switching individual antenna elements on and off by a controller based at least in part on orientations of the individual antenna elements relative to satellites of the satellite constellation, wherein an orientation of an individual antenna element relative to a satellite of the satellite constellation is correlated with a strength of RF signals received by the individual antenna element from the satellite of the satellite constellation.

7. The method of claim 6, wherein the coordinate system is spherical or Cartesian.

8. The method of claim 6, wherein enhancing gain including using a gain enhancement system selected from the group consisting of a lens system, a reflector system, a superstrate system, and combinations thereof.

9. The method of claim 8, wherein the lens system includes a semi-cylindrical or a cylindrical lens having a longitudinal axis oriented parallel to the first direction.

10. The method of claim 6, wherein the phased array antenna includes a predetermined number of M columns.

11. The method of claim 6, wherein the number of N rows is greater than or equal to the number of M columns.

12. The method of claim 6, wherein the controller receives an input from a global positioning system (GPS), and wherein the input includes a position of one or more satellites of the satellite constellation.

13. A phased array antenna system configured for communication with a satellite that emits or receives radio frequency (RF) signals and has a ground track in a first direction, the antenna system comprising:

a phased array antenna including a plurality of antenna elements distributed in a plurality of M columns oriented in the first direction and a plurality of N rows extending in a second direction normal to the first direction, and a plurality of fixed phase shifters aligned for phase offsets between antenna elements in the first direction;

a gain-enhancement system configured for gain enhancement in the second direction of radio frequency signals received by and emitted from the phased array antenna; and a controller configured to turn individual antenna elements on and off based at least in part on orientations of the individual antenna elements relative to the satellite, wherein an orientation of an individual antenna element relative to the satellite is correlated with a strength of RF signals received by the individual antenna element from the satellite.

* * * * *